United States Patent [19]

Hart et al.

[11] Patent Number: 4,793,446

[45] **Date of Patent: * Dec. 27, 1988**

[54] SINGLE-CYLINDER, TRUCK-MOUNTED BRAKE ASSEMBLY

[75] Inventors: James E. Hart, Trafford; William K. Mong, North Huntingdon; Allen W. Kyllonen, Plum; Mark S. Krampitz, Hunker, all of Pa.

[73] Assignee: American Standard Inc., Wilmerding, Pa.

[ * ] Notice: The portion of the term of this patent subsequent to Sep. 23, 2003 has been disclaimed.

[21] Appl. No.: 939,996

[22] Filed: Dec. 10, 1986

[51] Int. Cl.[4] ..... B61H 13/00; B61H 13/34

[52] U.S. Cl. ..... 188/52; 188/53

[58] Field of Search ..... 188/52, 53, 54, 55, 188/56; 74/480 R

[56] References Cited

U.S. PATENT DOCUMENTS

| | | | |
|---|---|---|---|
| 719,148 | 1/1903 | Shelton | 188/53 X |
| 3,177,984 | 4/1965 | Taylor | 188/52 |
| 4,258,830 | 3/1981 | Peerson et al. | 188/52 |
| 4,613,016 | 9/1986 | Hart et al. | 188/52 |

FOREIGN PATENT DOCUMENTS

| | | | |
|---|---|---|---|
| 0999605 | 7/1965 | United Kingdom | 188/52 |

*Primary Examiner*—Andres Kashnikow

*Assistant Examiner*—Richard Potosnak

*Attorney, Agent, or Firm*—G. J. Falce

[57] ABSTRACT

A single-cylinder, truck-mounted brake assembly for a railway vehicle truck in which low-cost, lightweight, truss-type brake beams are employed, with one beam having the single brake cylinder mounted thereon. Force-transfer levers pivotally-mounted to the respective brake beams at the beam-midpoint are interconnected by force-transmitting members that pass through openings in the bolster to move the brake beams into brake shoe/wheel engagement when a brake application is made. The brake rigging is set up so that the transfer lever bail imparted to the force-transmitting members is split. With respect to the force-transfer lever connected to the one force-transmitting member (brake cylinder), this has the effect of the brake cylinder piston skewing equally on opposite sides of the cylinder centerline to prevent piston seal leakage. In addition, diagonally-opposed lever arms of the respective force-transfer levers are greater in length than the other lever arms to obtain brake force multiplication without unbalancing the brake shoe forces. A further advantage found by making the one transfer lever arm longer than the corresponding lever arm of the other transfer lever is to split the lateral swing of the other force-transmitting member (slack adjuster) equally on opposite sides of the centerline of the bolster opening to avoid interference therebetween.

27 Claims, 5 Drawing Sheets

Figure 1:
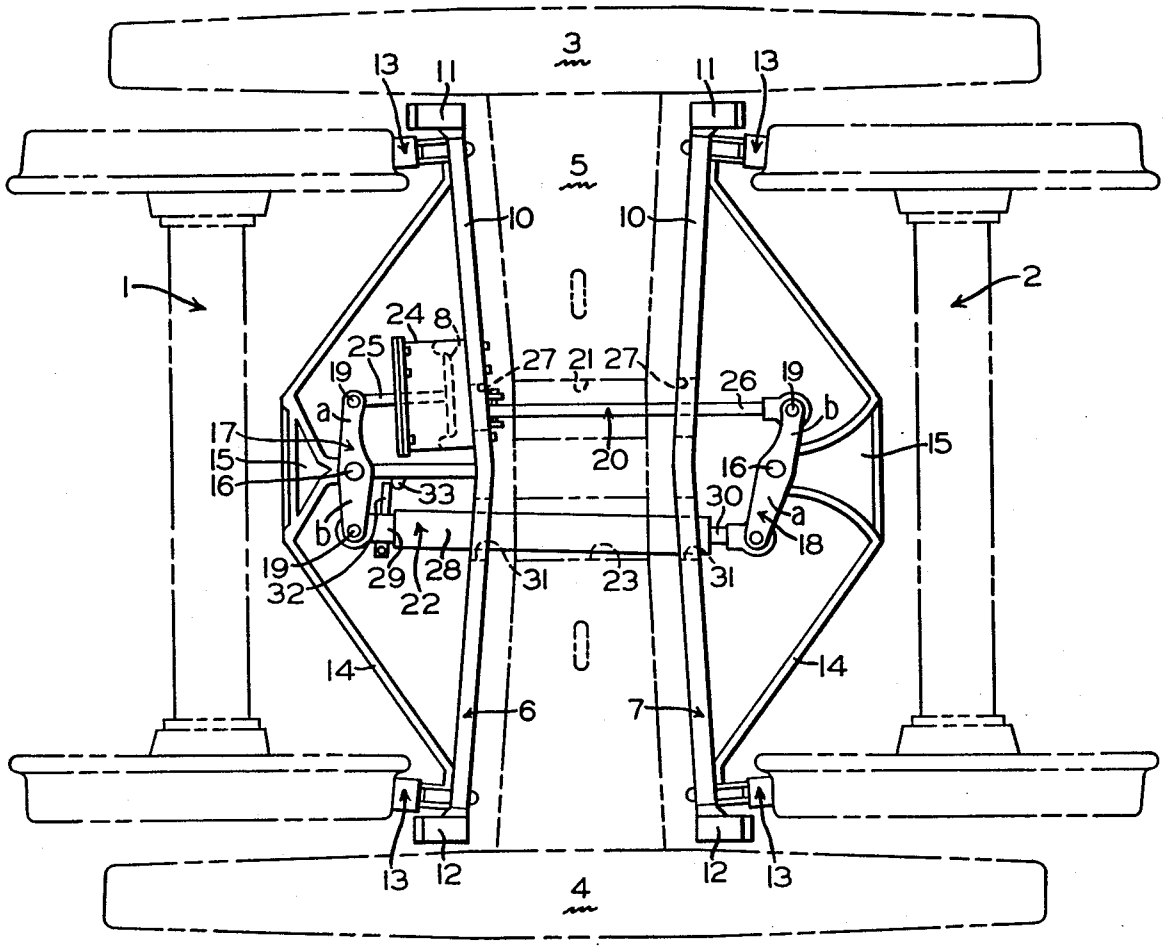

— = BRAKE RELEASE POSITION
- - = NORMAL APPLICATION POS.
—·— = MAXIMUM APPLICATION POS.

—— = BRAKE RELEASE POSITION
– – – = NORMAL APPLICATION POS.
—·— = MAXIMUM APPLICATION POS.

SINGLE-CYLINDER, TRUCK-MOUNTED BRAKE ASSEMBLY

BACKGROUND OF THE INVENTION

The present invention relates to single-cylinder, truck-mounted brake rigging and, particularly, to such a rigging arrangement in which force-transmitting members pass through openings in the truck bolster to apply braking force to conventional, truss-type brake beams located on opposite sides of the bolster.

A brake rigging of the aforementioned-type is shown in U.S. Pat. No. 4,613,016 and comprises, in addition to the brake beams, a force-transfer lever that is pivotally-connected to each brake beam at its midpoint, with the corresponding lever arms of these force-transfer levers being connected to the force-transmitting members. One force-transmitting member comprises a slack adjuster device, such as that disclosed in copending U.S. application Ser. No. 714,596. The other force-transmitting member includes a brake cylinder device, the body of which is mounted on one brake beam between the beam tension and compression members adjacent the strut bar, and a connecting rod between the transfer lever arm of the other brake beam and the cylinder body. The brake cylinder piston push rod is connected to the transfer lever arm of the one brake beam. Because of space limitations dictated by the cylinder location between the beam tension and compression members, the size of the brake cylinder is such that force amplification is required to obtain the desired brake forces. In addition, the size of the bolster openings is restrictive with respect to the force-transmitting members passing through these openings. This is especially true when a slack adjuster device is employed as the one force-transmitting member, due to the relatively large diameter of slack adjusters. Accordingly, the arcuate swing of the transfer levers, as they rotate from brake-release to brake-application positions through the range of new to condemned conditions of brake shoe/wheel wear, and the consequent bailing action of the slack adjuster, makes this restriction of the bolster opening especially critical. This is even more significant due to the fact that over-travel of the brake cylinder piston beyond a nominal piston stroke must be provided in accordance with A.A.R. requirements, in order to take up slack due to brake shoe/wheel wear, in the event of slack adjuster failure. This over-travel of the effective piston stroke increases the arcuate swing of the transfer levers and, accordingly, further increases the bailing action of the force-transmitting members. Moreover, the arcuate swing of the respective transfer levers differs as brake shoe/wheel wear progresses, since only the transfer lever associated with the non-cylinder brake beam is affected by the slack adjuster action, while the arcuate swing of the other transfer lever remains the same throughout the brake shoe/wheel wear range. Thus, not only does the degree of bailing action of the force-transmitting members change, but the force-transmitting members tend to assume a cocked disposition with respect to the opening through the bolster, as the angularity of the one transfer lever changes relative to the other. Due to this cocked disposition and lateral swing, particularly when the force-transmitting member is the slack adjuster, clearance with the bolster opening is made even more critical.

SUMMARY OF THE INVENTION

It is, therefore, an object of the present invention to provide force amplification through the brake rigging to make possible the use of a single, beam-mounted, brake cylinder within the existing space between the brake beam tension and compression members.

Another object of the invention is to maximize the force-transfer from the brake cylinder to the force-transmitting members of the rigging with respect to the arcuate swing of the transfer levers.

A further object of the invention is to establish balanced forces on the respective brake beams.

A still further object is to minimize the possibility of interference between the slack adjuster and bolster.

The foregoing objectives are accomplished by sizing the one arm of a first transfer lever associated with the cylinder-mounted brake beam, so as to be aligned substantially with the centerline of the bolster opening through which the slack adjuster passes when the transfer lever is perpendicular to the longitudinal centerline of the truck. The other arm of this transfer lever is connected to the piston push rod of the brake cylinder device which, being mounted to the brake beam, can be offset outboard of the centerline of the other opening in the bolster. This makes it possible to increase the length of this other lever arm of the transfer lever relative to the one lever arm to obtain mechanical advantage through the rigging.

In addition, one lever arm of a second transfer lever associated with the non-cylinder brake beam is made longer than the corresponding lever arm of the first transfer lever. Thus, when the second transfer lever is perpendicular to the longitudinal axis of the truck, the connection of the slack adjuster therewith skews the slack adjuster a maximum amount to one side of the centerline of the bolster opening through which the slack adjuster passes. This has the advantageous effect, during operation, of causing the slack adjuster to become skewed oppositely from its initial skewed disposition and also situated off-center on the opposite side of the centerline of the bolster opening by the same amount as it was skewed on the one side of the centerline. Accordingly, the effect of the transfer arm bail on the slack adjuster combined with the skewed disposition of the slack adjuster, due to different degrees of rotation of the respective transfer levers, is minimized with respect to interference between the slack adjuster and the bolster opening through which the slack adjuster passes.

Still further, the other lever arm of the second transfer lever can be made the same size as the one lever arm of the first transfer lever, so as to be substantially aligned with the centerline of the other opening of the bolster, since a connecting rod connects this other lever arm of the second transfer lever to either the cylinder-mounted brake beam or to the cylinder itself. This connection of the connecting rod with respect to the other opening in the bolster has greater latitude, since the diameter of the connecting rod is considerably less than that of the slack adjuster and, therefore, interference with the bolster is less likely to be a factor. This achieves the possibility of making the oppositely-disposed lever arms of the respective transfer levers of equal length, while the corresponding lever arms are of different length, thus achieving balanced forces at the respective brake beams.

Figure 2A:
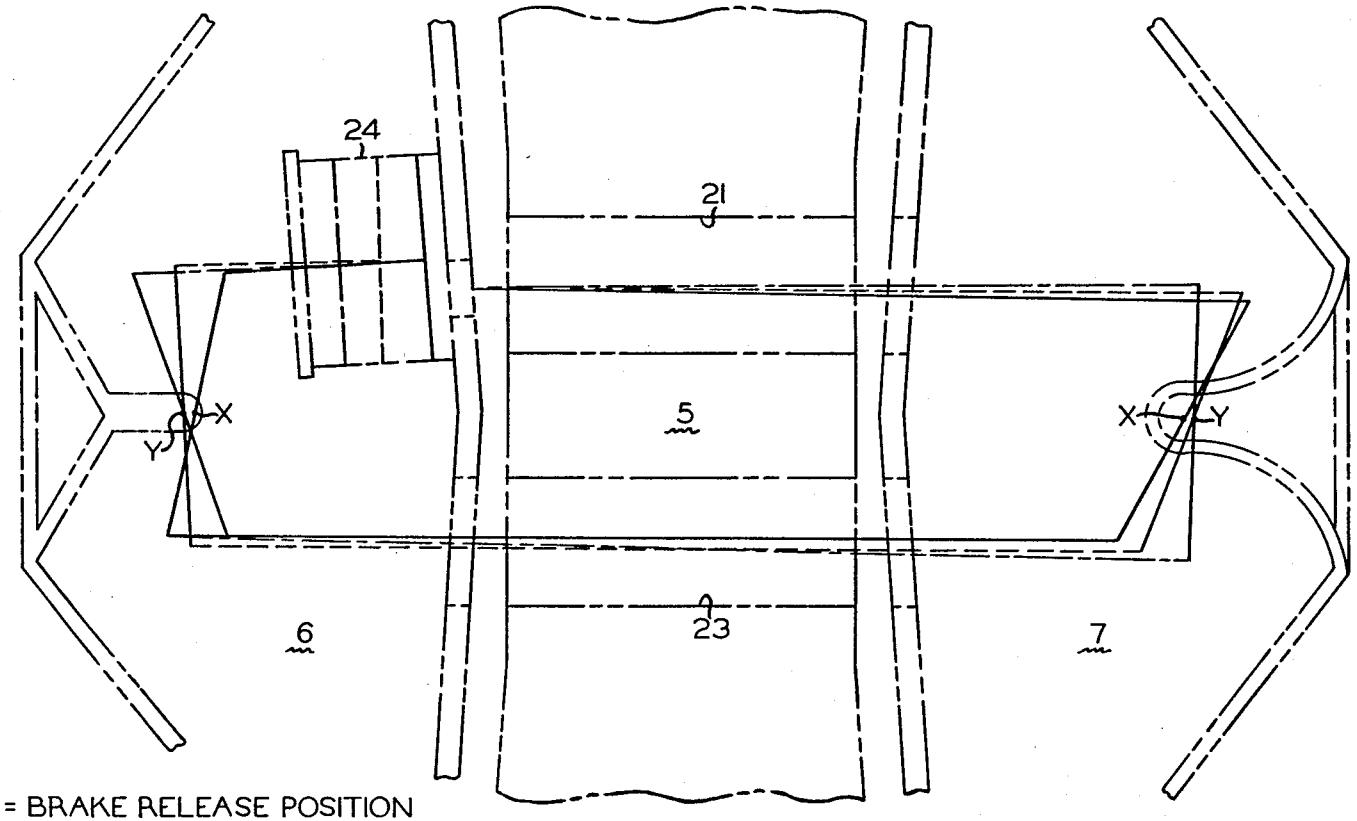
Figure 2B:
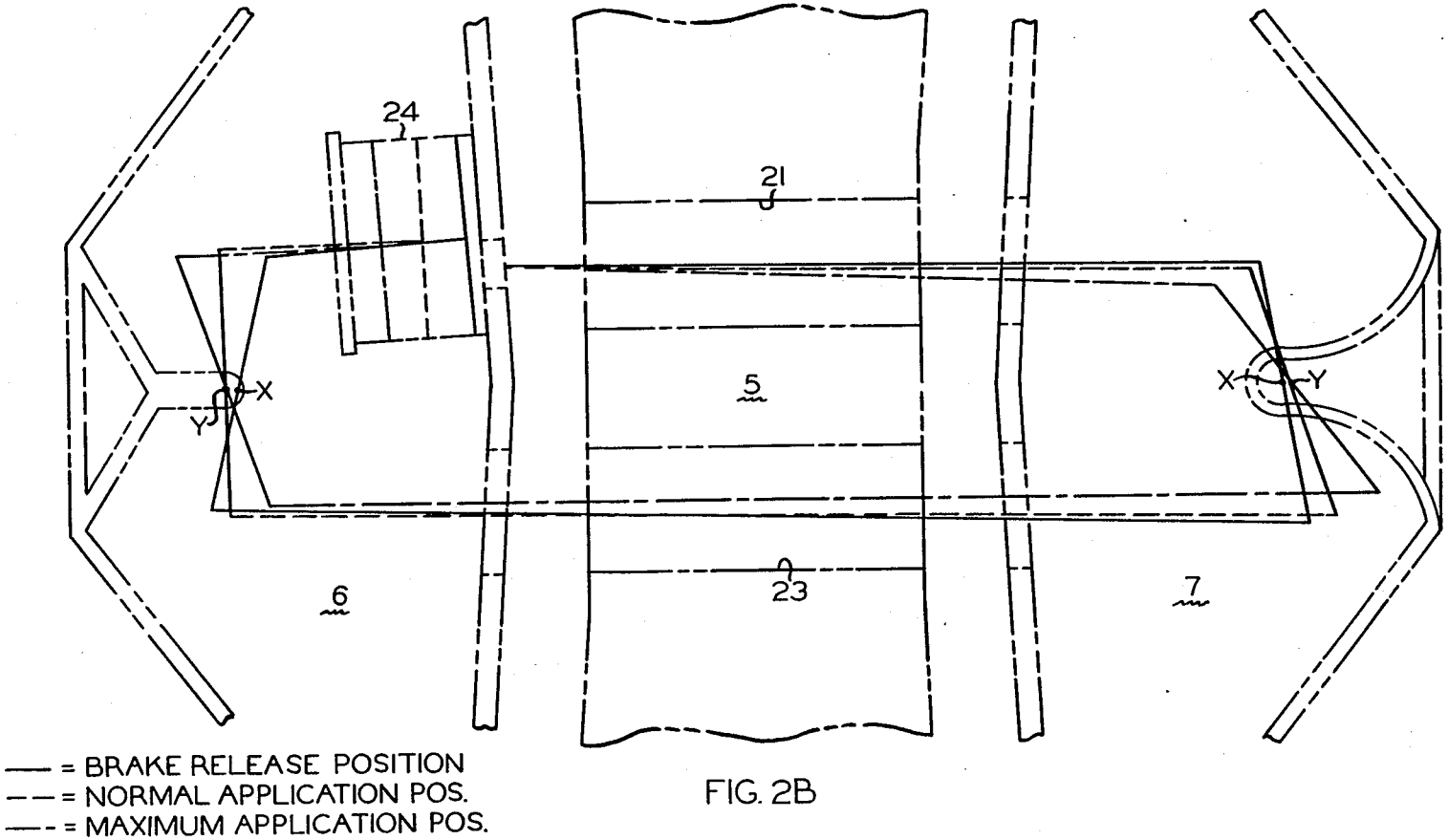
Figure 3A:
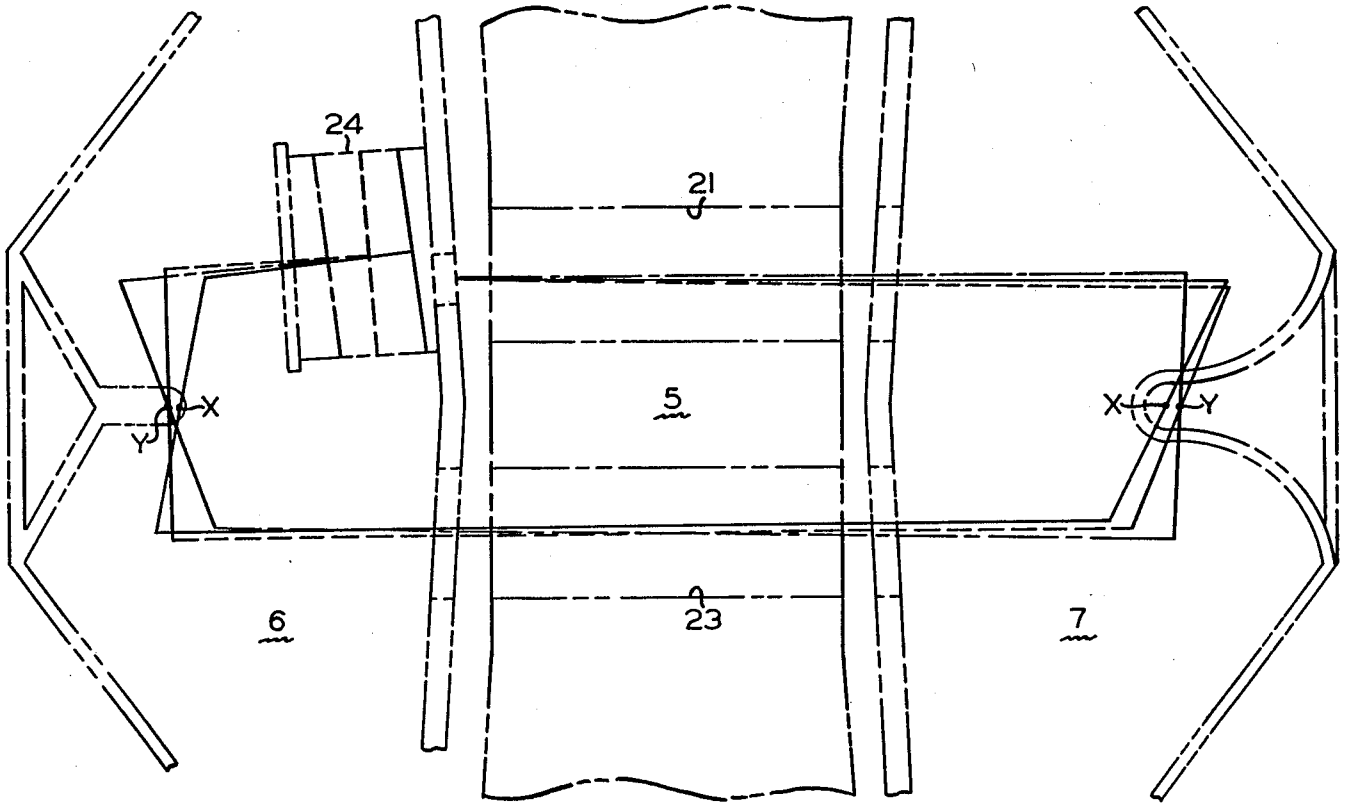
Figure 3B:
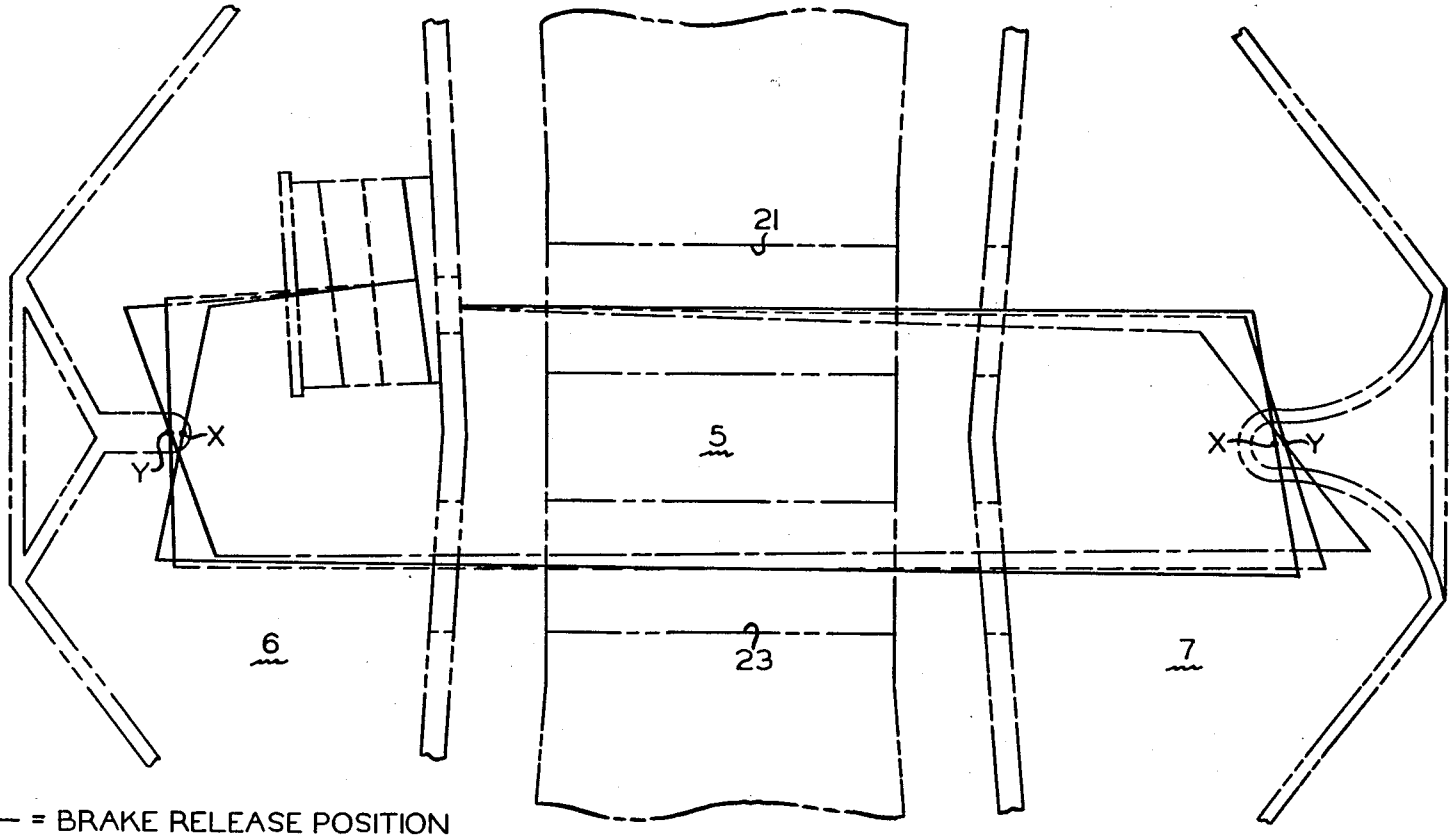

These and other objects and attendant advantages of the invention will become apparent from the following more detailed explanation, when taken with the accompanying drawings, in which:

FIG. 1 is an assembly plan view of a railway car truck having conventional truss-type brake beams, on one of which is mounted a single brake cylinder for providing braking force through transfer levers pivotally-mounted to a respective brake beam, and force-transmitting members that pass through openings in the bolster for connection with the respective lever arms of the transfer levers;

FIG. 2A is a view showing the brake rigging arrangement of FIG. 1 graphically, to illustrate the lateral swing of the force-transmitting members with respect to the bolster openings due to transfer lever bail, as the transfer lever rotates with brake cylinder piston travel, when the rigging reflects a new condition of brake shoe/wheel wear and the opposing lever arms of the respective transfer levers are different in length;

FIG. 2B is a view similar to FIG. 2A, showing the lateral swing of the force-transmitting members with respect to the bolster openings, as the arcuate position of the transfer lever associated with the non-cylinder brake beam changes under a condemned condition of brake shoe/wheel wear;

FIG. 3A is a view showing the brake rigging arrangement of FIG. 1 graphically, to illustrate the lateral swing of the force-transmitting members with respect to the bolster openings due to transfer lever bail, as the transfer lever rotates with brake cylinder piston travel, when the brake rigging reflects a new condition of brake shoe/wheel wear and the opposing lever arms of the different transfer levers are the same in length; and FIG. 3B is a view similar to FIG. 3A, showing the lateral swing of the force-transmitting members with respect to the bolster openings, as the arcuate position of the transfer lever associated with the non-cylinder brake beam changes under a condemned condition of brake shoe/wheel wear.

DESCRIPTION AND OPERATION

Referring to FIG. 1 of the drawings, a railway car truck is shown comprising a pair of wheel/axle units 1 and 2, a pair of side frames 3 and 4 supported on the wheel/axle units by a journal bearing in a conventional, well-known manner, and a bolster 5 that is spring-supported at its ends on the respective side frames, also in a conventional manner. A pair of parallel brake beams 6 and 7 are spaced-apart on opposite sides of bolster 5, and extend laterally between the side frames, with their ends being supported in guide pockets (not shown) formed in the truck side frames.

Brake beams 6 and 7 are similar in construction, each including a compression member 10 that extends laterally between the side frames, with guide feet 11 and 12 fixed in a suitable manner to the ends of compression member 10 so as to ride in the guide pockets, and thereby guidably-support the brake beams at the proper height above the rails and somewhat below the axis of a wheel/axle unit. Also fixed to each brake beam near the ends of compression member 10 adjacent the wheel treads in a well-known, conventional manner, is a brake head and brake shoe assembly 13. The guide pockets are formed in the truck side frames at a slight angle with the horizontal, so that movement of the brake beams during a brake application brings the brake shoes radially into engagement with the wheel treads.

Also fixed to each end of compression member 10 is a laterally-extending tension member 14, the center of which is rigidly-connected to the midpoint of compression member 10 by a strut bar 15. As is well-known in the railway braking art, truss-type brake beams are capable of supporting relatively high bending forces, by reason of the stress in tension member 14 increasing as compression member 10 tends to bend under the braking load, thereby counteracting such bending tendency. Consequently, brake beams 6 and 7, while being made of relatively lightweight construction, are sufficiently strong to withstand the force of braking transmitted to brake head and brake shoe assembly 13 via the breake beams.

Pivotally-connected by a pin 16 to strut bar 15 of the respective brake beams are force-transfer levers 17 and 18, each having one lever arm (a) longer than the opposing lever arm (b). It is important to note that lever arm (a) of force-transfer lever 17 is on one side of the truck longitudinal centerline, while lever arm (a) of force-transfer lever 18 is on the opposite side. Connected by pins 19 to lever arms 17(*a*) and 18(*a*) is a force-transmitting member 20 that passes through an opening 21 in bolster 5. Similarly, lever arms 17(*b*) and 18(*a*) are connected by pins 19 to a force-transmitting member 22 that passes through an opening 23 in bolster 5. These openings 21, 23 are standard in bolster 5, being spaced on centers 5.5 inches on opposite sides of the truck longitudinal centerline.

Force-transmitting member 20 includes a brake actuator, such as a conventional brake cylinder device 24, for example, the pressure head of which may be bolted, or otherwise secured to compression member 10 of one brake beam 6 at a location between the compression and tension members adjacent one side of strut bar 15. Brake cylinder device 24 includes a piston 8 and a piston push rod 25 that forms the portion of force-transmitting member 20 that is connected to lever arm 17(*a*). A connecting rod 26 forms that portion of force-transmitting member 20 that passes through opening 21 and is connected at one end to lever arm 18(*b*). The other end of connecting rod 26 abuts the pressure head of brake cylinder device 24, which may be formed with a conically-shaped concavity to receive a sperhical-shaped end of the connecting rod 26, so as to accommodate bail action and other relative motion between brake beam 6 and connecting rod 26. Openings 27 are provided in brake beams 6 and 7 in substantial alignment with opening 21 of bolster 5 to accommodate passage of connecting rod 26. It will be appreciated that an alternative arrangement would be one in which the other end of connecting rod 26 is arranged to abut directly with brake beam 6, as opposed to abutting the brake cylinder pressure head, which is bolted to the brake beam.

Force-transmitting member 22 comprises a slack adjuster device 28, such as that disclosed in U.S. application Ser. No. 714,596, assigned to the assignee of the present invention. One end 29 of the slack adjuster housing is connected to lever arm 17(*b*) while the opposite end 30, associated with an extensible rod of the slack adjuster, is connected to transfer lever arm 18(*a*). In order to accommodate passage of the slack adjuster device for connection with the respective transfer levers, the brake beams 6 and 7 are each provided with an opening 31 that is substantially aligned with opening 23 in bolster 5.

A trigger arm 32 is pivotally-connected to the slack adjuster housing at its outboard-side, and passes laterally through openings (not shown) in the slack adjuster housing into proximal engagement with a stop lug 33 on strut bar 15 of brake beam 6. The trigger arm thus rotates in response to relative movement between brake beam 6 and force-transmitting member 22 (slack adjuster 28), as a means of detecting excessive piston travel due to brake shoe/wheel wear. When this excessive piston travel is detected, the trigger arm operates to cause the extensible rod of slack adjuster end 30 to be extended relative to the slack adjuster housing.

It should be noted, at this point, that the system is designed to operate with a nominal piston stroke of 2 inches. This nominal 2-inch stroke of the brake cylinder piston, in response to the supply of compressed air to the brake cylinder device 24, effects counterclockwise rotation of force-transfer lever 17 about its pivot pin 16. This rotation of force-transfer lever 17 causes axial movement of slack adjuster device 28 in the direction of the right hand to, in turn, effect counterclockwise rotation of force-transfer lever 18 about its pivot pin 16. In that connecting rod 26 abuts the pressure head of brake cylinder device 24, resistance to movement is encountered at lever arm 18(*b*) so that force-transfer lever 18 acts as a second-class lever. Thus, the force exerted at lever arm 18(*a*), via slack adjuster device 28, causes force-transfer lever 18 to pivot about its connection with connecting rod 26 to thereby move brake beam 7 in the direction of the right hand, through the connection of force-transfer lever 18 with strut bar 15, until the brake shoes of brake head assemblies 13 associated with brake beam 7 come into engagement with the wheel treads of wheel/axle unit 2.

Once brake shoe engagement occurs at brake beam 7, the connection of lever arm 18(*a*) with extensible arm 30 of force-transmitting member 22 becomes solid, thus causing force-transfer lever 17 to become a second-class lever, since continued rotation thereof now occurs about pin 19 that connects lever arm 17(*b*) with the housing end 28 of force-transmitting member 22. Thus, the brake cylinder force acts through pivot pin 16 of force-transfer lever 17 and strut bar 15 to force brake beam 6 in the direction of the left hand, thereby bringing the brake shoes of brake head assemblies 13 associated with brake beam 6 into engagement with the wheel treads of wheel/axle unit 1.

As shown in FIG. 2A, this movement of the respective brake beam to take up the brake shoe clearance is represented by points X and Y corresponding to the pivot pin connections 16 of force-transfer levers 17, 18 with the brake beams 6, 7. Slack adjuster device 28 operates to maintain brake shoe/wheel engagement with 2-inch piston travel corresponding to "nominal application" position through the full range of brake shoe/wheel wear. An additional 2 inches of piston travel is provided to assure brake shoe/wheel engagement in the event of slack adjuster failure, thus making the total possible piston stroke 4 inches.

With respect to force-transfer lever 17 associated with brake beam 6, the transfer lever pivot point along strut bar 15 is selected so that in the mid-position of its rotation, corresponding to "nominal application" position of the brake cylinder piston, the force-transfer lever 17 lies substantially perpendicular to the line of action of piston push rod 25 (discounting the effect of the slight angle of the brake beam compression member on which the brake cylinder device is mounted). Consequently, force-transfer lever 17 is capable of rotating in one direction from its mid-position correspondingy to "nominal application" position of the brake cylinder piston equally in opposite directions with piston movement between "maximum application" and "release" position, thus splitting the amount of bail resulting from the total angular displacement of the force-transfer lever, as can be seen in FIGS. 2A, 2B, 3A, and 3B. This has the advantage of minimizing the cocking effect of bail action on the brake cylinder piston to maintain its seal integrity through the full stroke of the piston, as well as maximizing the mechanical advantage of the force-transfer from brake cylinder device 24 to force-transfer lever 17 at the time the brake shoes are in braking engagement with the wheel treads, i. e., "nominal application" position of the force-transfer lever.

With respect to force-transfer lever 18 associated with brake beam 7, its total angular displacement is greater than that of force-transfer lever 17, since extension of the slack adjuster 28 with brake shoe wear, in addition to piston stroke, is reflected in rotation of this force-transfer lever 18. The degree of extension of slack adjuster 28 is selected so as to correspond to the maximum stroke of piston 8, i. e., 4 inches.

It has been found that by locating the pivot point of force-transfer lever 18 along strut bar 15 of beam 7, so that the force-transfer lever lies substantially perpendicular to the longitudinal axis of the truck when the brake cylinder piston is in "maximum application" position under new brake shoe/wheel conditions, the maximum degree of lever rotation corresponding to "release" position of the brake cylinder piston will be substantially the same as lever rotation in the opposite direction corresponding to "maximum application" position of the brake cylinder piston under condemning limits of brake shoe/wheel wear, i. e., when the slack adjuster is fully extended. Therefore, the amount of bail of force-transmitting member 22, due to variation in the angularity of force-transfer lever 18, is split. This is extremely important because of the relatively close clearance between bolster opening 23 and slack adjuster 28, comprising force-transmitting member 22.

Since it is desirable to align the connection of force-transmitting member 22 and lever arm 17(*b*) with the center of opening 23, it will be appreciated that the dimension of lever arm 17(*b*) is made 5.5 inches, corresponding to the previously-stated 5.5 inch dimension from the center of bolster 5 to the center of opening 23. The other lever arm 17(*a*) is 6.5 inches long, which means that brake cylinder device 24 is offset from the center of opening 21. The resultant lever ratio thus realized is important in obtaining the mechanical advantage necessary to achieve the desired braking forces, since the size of brake cylinder device 24 is limited by the available mounting space between the brake beam compression and tension members adjacent strut bar 15. Offsetting brake cylinder device 24 from opening 21 is made possible by the fact that connecting rod 26 is not integral with the brake cylinder, and by the fact that the diameter of this connecting rod 26 is considerably less than that of opening 21. Accordingly, connecting rod 26 has abutting engagement with a conically-shaped concavity in the brake cylinder pressure head at a point that is slightly offset from the brake cylinder centerline, and that locates the connecting rod near the outer side of opening 21 on the side of bolster 5 adjacent brake beam 6.

The lever arms of force-transfer lever 18 are also of different length, preferably the same dimensions as the lever arms of force-transfer lever 17, but reversed endfor-end therefrom. Accordingly, lever arm 18(*a*) is 6.5 inches long and lever arm 18(*b*) is 5.5 inches long, the net result being balanced forces acting on the respective brake beams 6 and 7. In addition, the fact that lever arm 18(*a*) is longer than lever arm 17(*b*) helps in maintaining slack adjuster device 28 centered with respect to the opening 23 on the side of bolster 5 adjacent brake beam 7, since force-transfer lever 18 associated with brake beam 7 has a greater total angle of rotation than force-transfer lever 17, and thus produces a greater degree of bail.

This feature of the invention is illustrated by comparison of FIGS. 2A, 2B with FIGS. 3A, 3B. FIGS. 2A and 2B show the centerlines of the respective force-transfer levers 17 and 18, their pivot connections 16 with the respective brake beams 6 and 7, and force-transmitting members 20 and 22 passing through openings 21 and 23.

In FIGS. 2A and 2B, force-transfer levers 17 and 18 are shown in a "brake release" position represented by a solid line, "nominal application" position represented by a dashed line, and "maximum application" position represented by a dot-dashed line. As mentioned heretofore, the angular disposition of force-transfer lever 18 changes for a given braking condition, depending upon the degree of extension of slack adjuster device 28 to compensate for brake shoe/wheel wear. FIG. 2A shows different angular displacements of force-transfer lever 18 during a new brake shoe/wheel condition, while FIG. 2B shows the same different angular displacements of force-transfer lever 18 during a condemned limit of brake shoe/wheel wear. From a comparison of FIGS. 2A and 2B, it will be seen that transfer lever 18 has the greatest degree of bail and thus produces the greatest lateral swing of slack adjuster 28, when the brake shoe/wheel wear is at a condemned limit. This is clearly shown in FIG. 2B, where the solid line represents the extreme lateral swing of slack adjuster device 28 on one side of the centerline of opening 23, and the dot/dashed line represents the extreme lateral swing of slack adjuster 28 on the other side of the centerline of opening 23. It will be apparent that the slack adjuster swing, due to the bail of the transfer levers, is thus split equally on opposite sides of the centerline of bolster opening 23.

On the contrary, a close examination of the arrangement shown in FIGS. 3A and 3B, in which the length of lever arm 18(*a*) is only 5.5 inches so as to be aligned with the centerline of opening 23, the lateral swing of slack adjuster 28, due to the bail of force-transfer lever 18, is totally on one side of the centerline of opening 23. Thus, even though lever arm 18(*a*) is shorter than in the case of the FIG. 3A, 3B arrangement, so as to have less bail, the total lateral swing of slack adjuster device 28, due to this bail, is all on the one side of the centerline of opening 23.

It will, therefore, be seen that by making lever arm 18(*a*) greater than the dimension from the bolster center to the centerline of bolster opening 23, i. e., 6.5 inches, as opposed to 5.5 inches, the lateral slack adjuster swing due to the transfer lever bail is split substantially equally on opposite sides of the centerline of bolster opening 23, thereby providing less chance of interference between the slack adjuster and the sides of bolster opening 23.

The other lever arm 18(*b*) of force-transfer lever 18 is 5.5 inches in length, corresponding to the dimension of lever arm 17(*b*) of force-transfer lever 17. Since the diameter of connecting rod 26 is small relative to that of slack adjuster device 28, interference with its bolster opening 21 is unlikely, so that the effect of bail from lever arm 18(*b*) is less critical than the effect of bail from lever arm 18(*a*).

We claim:

1. For a railway vehicle truck having a longitudinal axis, a transverse axis perpendicular thereto, a pair of wheel/axle units parallel to said transverse axis, a bolster so disposed between said pair of wheel/axle units that its axis coincides with said transverse axis, said bolster having first and second openings spaced equidistantly on opposite sides of said longitudinal axis and passing through said bolster in a direction parallel thereto, a brake rigging comprising:

(a) first and second brake beams interposed between said bolster and a respective one of said wheel/axle units so as to be in substantially parallel relationship with said bolster, said first and second brake beams having brake shoes carried thereon adjacent the wheel treads of said wheel/axle units for engagement therewith when said brake beams are spread apart;

(b) first and second transfer levers pivotally-connected, respectively, at a point intermediate the ends thereof to said first and second brake beams, each said transfer lever forming first and second lever arms, the effective lengths of said first and second lever arms of at least one of said first and second transfer levers being dissimilar;

(c) first force-transmitting means passing through said first opening of said bolster for connection with said first lever arms of said first and second transfer levers, said first force-transmitting means including force actuator means for effecting rotation of said first transfer lever; and (d) second force-transmitting means passing through said second opening of said bolster for connection with said second lever arms of said first and second transfer levers to effect rotation of said second transfer lever, whereby a force is exerted on said first and second brake beams, at said pivotal connection of said first and second transfer levers therewith, in opposite directions.

2. A brake rigging, as recited in claim 1, wherein the length of said first lever arm of said first transfer lever is larger than the length of said second lever arm thereof.

3. A brake rigging, as recited in claim 2, wherein said pivotal connection of said first and second transfer levers with said first and second brake beams is at the midpoint of said brake beams.

4. A brake rigging, as recited in claim 3, wherein said force actuator means comprises:

(a) a brake cylinder body mounted on said first brake beam adjacent said pivotal connection of said first transfer lever;

(b) a fluid-pressure-operable piston housed within said brake cylinder body; and (c) a push rod connected at one end to said piston and at the other end to said first lever arm of said first transfer lever, said piston having a "release" position in which said brake shoes are disengaged from the wheel treads of said wheel/axle units a predetermined distance, a "nominal brake application" position in which said brake shoes are moved said predetermined distance into engagement with the wheel treads of said wheel/axle units, and a "maximum brake application" position corresponding to the maximum stroke of said piston.

5. A brake rigging, as recited in claim 4, wherein said first force-transmitting means further comprises a connecting rod that passes through said first opening in said bolster and is connected between said first lever arm of said second transfer lever and said brake cylinder body.

6. A brake rigging, as recited in claim 5, wherein the effective length of said second lever arm of said first transfer lever corresponds to the distance between said longitudinal axis and the axis of said second opening.

7. A brake rigging, as recited in claim 6, wherein said second force-transmitting means comprises slack adjuster means for varying the length of said second force-transmitting means as brake shoe/wheel wear progresses, said slack adjuster means being initially set in accordance with a new condition of brake shoe/wheel wear, such that said second transfer lever is angularly-displaced in one direction from a reference position that is substantially parallel with said longitudinal axis when said piston is in said "nominal brake application" position, the length of said second force-transmitting means being increased by said slack adjuster means in accordance with a condemned limit of brake shoe/wheel wear, such that said second transfer lever is angularly-displaced from said reference position in a direction opposite said one direction when said piston is in said "nominal brake application" position.

8. A brake rigging, as recited in claim 1, wherein the effective lengths of said first and second lever arms of each of said first and second transfer levers are dissimilar.

9. A brake rigging, as recited in claim 8, wherein said first lever arms of said first and second transfer levers are on a corresponding side of said pivot connection thereof, and said second lever arms of said first and second transfer levers are on the corresponding opposite side of said pivotal connection.

10. A brake rigging, as recited in claim 9, wherein the effective length of said first lever arm of said first transfer lever is greater than the effective length of said first lever arm of said second transfer lever.

11. A brake rigging, as recited in claim 9, wherein the effective length of said second lever arm of said second transfer lever is greater than the effective length of said first lever arm thereof.

12. A brake rigging, as recited in claim 9, wherein the effective length of said first lever arm of said first transfer lever is equal to the effective length of said second lever arm of said second transfer lever, said equal lever length being greater than the effective length of said first lever arm of said second transfer lever.

13. A brake rigging, as recited in claim 12, wherein the effective length of said second lever arm of said first transfer lever is equal to the effective length of said first lever arm of said second transfer lever.

14. A brake rigging, as recited in claim 13, wherein the effective length of said second lever arm of said first transfer lever corresponds to the distance between said longitudinal axis and the axis of said second opening.

15. A brake rigging, as recited in claim 1, wherein:

(a) said first force actuator means comprises:

(i) a brake cylinder body mounted on said first brake beam;

(ii) a fluid-pressure-operable piston housed within said brake cylinder body, said piston having a "release" position in which said brake shoes are disengaged from the wheel treads of said wheel/axle units a predetermined distance, a "nominal brake application" position in which said brake shoes are moved said predetermined distance into engagement with the wheel treads of said wheel/axle units, and a "maximum brake application" position corresponding to the maximum stroke of said piston, and (iii) a push rod connected at one end to said piston and at the other end to said first lever arm of said first transfer lever, such that when said piston is in said "nominal brake application" position, said first transfer lever lies in an "optimum" force-applying position substantially parallel to said transverse axis.

16. A brake rigging, as recited in claim 15 wherein said first transfer lever is rotated equally about said pivotal connection thereof with said first brake beam in opposite directions from said "optimum" position as said piston moves in opposite directions from said "nominal brake application" position to said "maximum brake application" position and to said "release" position, whereby the bail action imparted to said push rod and said piston by said first transfer lever is split.

17. A brake rigging, as recited in claim 15, wherein said second force-transmitting means includes slack adjuster means for varying the length of said second force-transmitting means as brake shoe/wheel wear progresses, said slack adjuster means being initially set in accordance with a new conditions of brake shoe/wheel wear, such that said second transfer lever is angularly-displaced in one direction from a reference position that is substantially parallel with said longitudinal axis when said piston is in said "nominal brake application" position, the length of said second force-transmitting means being increased by said slack adjuster means in accordance with a condemned limit of brake shoe/wheel wear, such that said second transfer lever is angularly-displaced from said reference position in a direction opposite said one direction when said piston is in said "nominal brake application" position.

18. A brake rigging, as recited in claim 17, wherein the effective length of said second lever arm of said first transfer lever corresponds to the distance between said longitudinal axis and the centerline of said second opening, the effective length of said second lever arm of said second transfer lever being greater than the effective lever length of said second lever arm of said first transfer lever.

19. For a railway vehicle truck having a longitudinal axis, a transverse axis perpendicular thereto, a pair of wheel/axle units parallel to said transverse axis, a bolster so disposed between said pair of wheel/axle units that its axis coincides with said transverse axis, said bolster having first and second openings spaced equidistantly on opposite sides of said longitudinal axis and passing through said bolster in a direction parallel thereto, a brake rigging comprising:

(a) first and second brake beams interposed between said bolster and a respective one of said wheel/axle units so as to lie in substantially parallel relationship with said bolster, said first and second brake beams having brake shoes carried thereon adjacent the wheel treads of said wheel/axle units for engagement therewith when said brake beams are spread apart;

(b) first and second transfer levers pivotally-connected, respectively, at a point intermediate the ends thereof to said first and second brake beams so as to form first and second lever arms of said transfer levers;

(c) first force-transmitting means comprising:

(i) a brake cylinder body mounted on said first brake beam, (ii) a fluid-pressure-actuated piston operably-disposed within said brake cylinder body, said piston having a "release" position in which said brake shoes are disengaged from the wheel treads of said wheel/axle units a predetermined distance, a "nominal brake application" position in which said brake shoes are moved said predetermined distance into engagement with the wheel treads of said wheel/axle units, and a "maximum brake application" position corresponding to the maximum stroke of said piston, (iii) a push rod connected at one end to said piston and at the other end to said first lever arm of said first transfer lever, such that when said piston is in said "nominal brake application" position, said first transfer lever lies in an "optimum" position substantially parallel to said transverse axis, whereby said first lever in said "release" position is angularly-displaced in one direction from said "optimum" position a given number of degrees and in said "maximum brake application" position is angularly-displaced said given number of degrees in the opposite direction from said "optimum" position, thereby substantially splitting the bail of said first transfer lever, and (iv) a connecting rod passing through said firt opening of said bolster having one end connected to said first lever arm of said second transfer lever, and the other end abutting said brake cylinder body; and (d) second force-transmitting means passing through said second opening of said bolster for connection with said second lever arms of said first and second transfer levers to effect rotation of said second transfer lever, whereby a force is exerted on said first and second brake beams at said pivotal connection of said first and second transfer levers therewith in opposite directions.

20. A brake rigging, as recited in claim 19, wherein the effective length of said first lever arm of said first transfer lever is greater than said second lever arm thereof.

21. A brake rigging, as recited in claim 20, wherein the effective length of said second lever arm of said first transfer lever corresponds to the distance between said longitudinal axis and the centerline of said second opening.

22. A brake rigging, as recited in claim 21 wherein said second force-transmitting means comprises slack adjuster means for varying the length of said second force-transmitting means as brake shoe/wheel wear progresses, said slack adjuster means being initially set in accordance with a new condition of brake shoe/-wheel wear, such that said second transfer lever is angularly-displaced in one direction from a reference position that is substantially parallel with said longitudinal axis when said piston is in said "nominal brake application" position, the length of said second force-transmitting means being increased by said slack adjuster means in accordance with a condemned limit of brake shoe/-wheel wear, such that said second transfer lever is angularly-displaced from said reference position in a direction opposite said one direction when said piston is in said "nominal brake application" position.

23. A brake rigging, as recited in claim 17, wherein said second force-transmitting means comprises slack adjuster means for varying the length of said second force-transmitting means as brake shoe/wheel wear progresses, said slack adjuster means being initially set in accordance with a new condition of brake shoe/-wheel wear, such that said second transfer lever is angularly-displaced in one direction from a reference position that is substantially parallel with said longitudinal axis when said piston is in said "nominal brake application" position, the length of said second force-transmitting means being increased by said slack adjuster means in accordance with a condemned limit of brake shoe/-wheel wear, such that said second transfer lever is angularly-displaced from said reference position in a direction opposite said one direction when said piston is in said "nominal brake application" position.

24. A brake rigging, as recited in claim 23, wherein the effective length of said first lever arm of said first transfer lever is greater than said second lever arm thereof.

25. A brake rigging, as recited in claim 24, wherein the effective length of said second lever arm of said first transfer lever corresponds to the distance between said longitudinal axis and the centerline of said second opening.

26. A brake rigging, as recited in claim 25, wherein the effective length of said second lever arm of said second transfer lever is greater than the effective length of said second lever arm of said first transfer lever.

27. A brake rigging, as recited in claim 26, wherein the effective length of said first lever arm of said first transfer lever is the same as the effective length of said second lever arm of said second transfer lever.

* * * * *

UNITED STATES PATENT AND TRADEMARK OFFICE

CERTIFICATE OF CORRECTION

PATENT NO. : 4,793,446

DATED : December 27, 1988

INVENTOR(S) : James E. Hart, William K. Mong, Allen W. Kyllonen, and Mark S. Krampitz It is certified that error appears in the above-identified patent and that said Letters Patent is hereby corrected as shown below:

Column 11, line 30, delete "firt" and insert --first--

Signed and Sealed this

Second Day of May, 1989

*Attest:*

*Attesting Officer*

DONALD J. QUIGG

*Commissioner of Patents and Trademarks*